US005116453A

United States Patent [19]

Niedrig

[11] Patent Number: 5,116,453

[45] Date of Patent: * May 26, 1992

[54] STRAPPING APPARATUS FOR A PACKAGING STRAP

[75] Inventor: Franklin Niedrig, Berikon, Switzerland

[73] Assignee: Strapex AG, Wohlen, Switzerland

[ * ] Notice: The portion of the term of this patent subsequent to Jun. 19, 2007 has been disclaimed.

[21] Appl. No.: 520,034

[22] Filed: May 7, 1990

Related U.S. Application Data

[62] Division of Ser. No. 168,411, Mar. 15, 1988.

[30] Foreign Application Priority Data

Mar. 20, 1987 [CH] Switzerland ..... 01084/87

[51] Int. Cl.[5] ..... B65B 13/22; B65B 13/34

[52] U.S. Cl. ..... 156/580; 53/582; 100/32; 100/33 PB; 156/496

[58] Field of Search ..... 156/486, 580; 100/32, 100/33 PB; 53/582

[56] References Cited

U.S. PATENT DOCUMENTS 3,566,778 3/1971 Vilcins .

4,934,261 6/1990 Niedrig ..... 156/496 X

OTHER PUBLICATIONS

U.S. patent application Ser. No. 404,848, filed by Kagi on Sep. 8, 1989.

*Primary Examiner*—David A. Simmons

*Assistant Examiner*—James J. Engel, Jr.

*Attorney, Agent, or Firm*—Collard, Roe & Galgano

[57] ABSTRACT

A thermoplastic tape is wrapped around a package and is tightened by the disclosed strapping or banding apparatus. The ends of the plastic tape can be welded together by a combined strapping and sealing apparatus or even with a separate sealing apparatus. The strapping apparatus includes a positioning system which ensures that a slotted wheel intended for tightening the plastic tape, once the operating cycle is complete, always assumes an optimum position for the re-insertion of the plastic tape. The use of the strapping apparatus is thereby substantially facilitated, since the operator normally does not have any hands free to adjust the slotted wheel that would otherwise be necessary for tape insertion.

7 Claims, 4 Drawing Sheets

Fig. 2
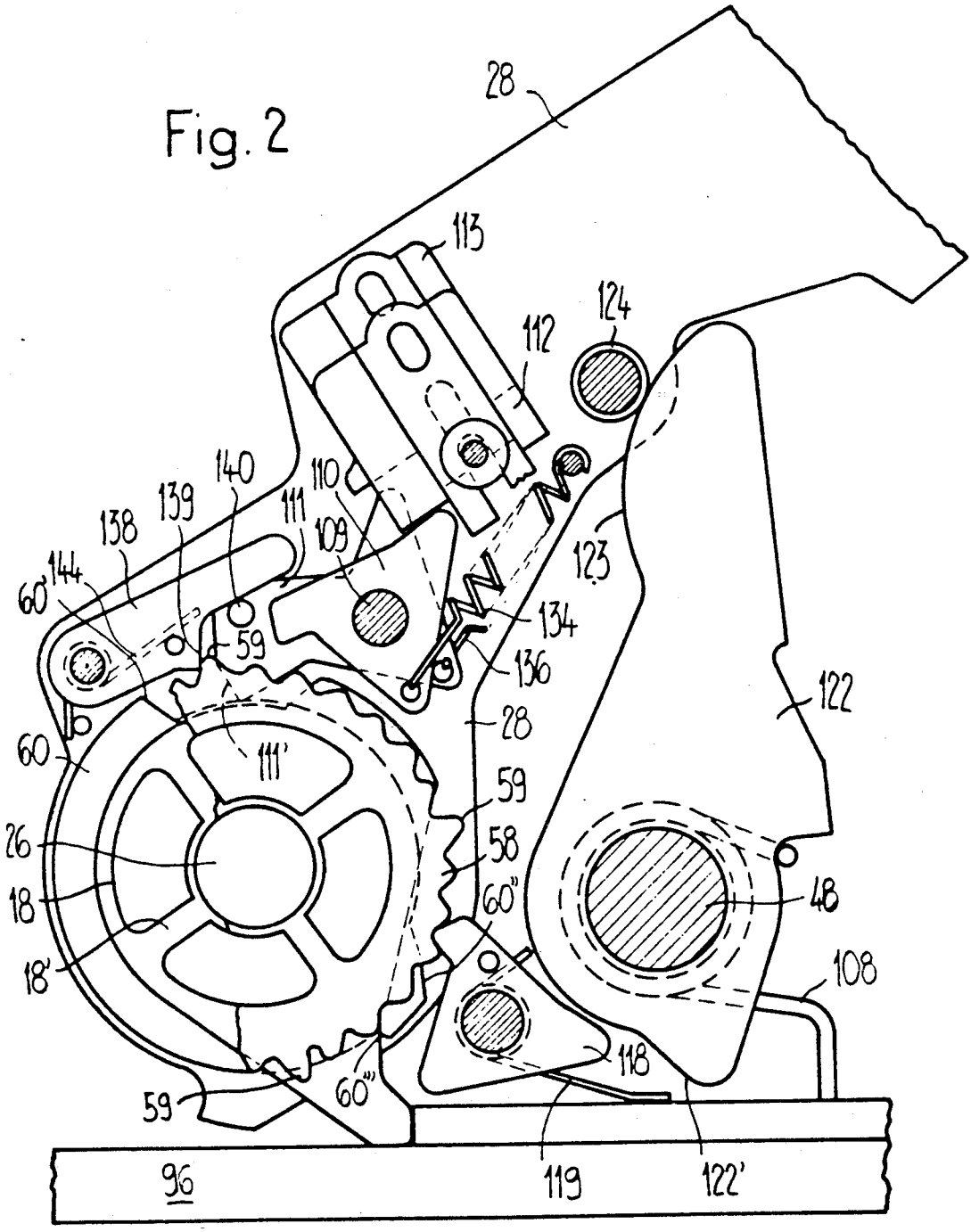
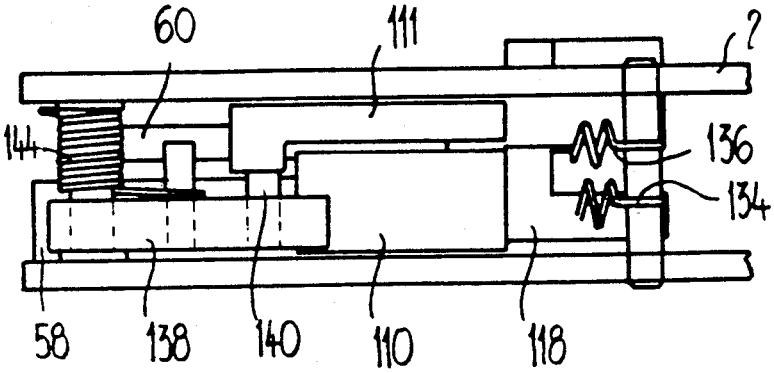
Fig. 3

STRAPPING APPARATUS FOR A PACKAGING STRAP

This is a divisional of copending application Ser. No. 07/168,411 filed on Mar. 15, 1988.

BACKGROUND OF THE INVENTION

1. Field of the Invention

The invention relates to a strapping or banding apparatus for applying packaging tape. More particularly, this invention relates to an apparatus for applying and sealing thermoplastic tape around a package or packages.

2. Description of the Prior Art

While the present invention relates to a strapping or banding apparatus, the invention can also be used in a combined strapping and sealing apparatus for plastic tape. Such a combined apparatus has been disclosed in European patent application EP-A1-0 188 720 (U.S. patent application Ser. No. 819,581). This prior art apparatus uses thermoplastic tape for strapping a package or a plurality of articles to be bundled together. This device includes a slotted wheel used to tighten the tape which wheel has slots arranged crosswise thereon. The slotted wheel is connected to a ratchet wheel for rotation therewith. The ratchet wheel is driven along in the tightening direction each time the actuating lever is reciprocated. Once the tightening operation is complete, the tape ends are welded together. While the tape ends can be welded together with the above-mentioned combined apparatus, it is also possible to use a strapping apparatus and a separate sealing apparatus.

Once the tightening and sealing operation is complete, the slotted wheel is in the final position reached during the previous tightening. Since the ratchet wheel has a relatively fine tooth pitch, a plurality of positions are possible. If the tape is to be reinserted into the slotted wheel after the package has been strapped to begin the next tightening operation, this slotted wheel is often not in the position suitable for insertion. Consequently it has to be turned manually to a suitable position prior to the re-insertion of the tape. This is laborious and time-consuming for the operator, since normally both hands are already occupied.

SUMMARY OF THE INVENTION

It is an object of the invention to provide a simplified strapping apparatus of the type using a slotted wheel to tighten the strap or tape material.

It is an additional object of the invention to provide a strapping apparatus in which it is easier to insert the tape into the slotted wheel prior to performing a tightening operation.

It is a further object of the invention to provide a strapping device which is simple in design, economical to manufacture and easy to operate.

Accordingly, these objects are achieved by a strapping apparatus having a slotted wheel which is capable of acting on plastic tape. This apparatus includes an actuating lever capable of rotating the slotted wheel in a manner which tightens the tape. A driving pawl is connected to the actuating lever and engages the slotted wheel via a ratchet wheel which is coupled to the slotted wheel for rotation therewith. Also included is a locking pawl which prevents the slotted wheel from reversing. Thus, as the handle is actuated, the driving pawl acts to tighten the plastic strap and the locking pawl prevents the reverse rotation of the slotted wheel. Once the strapping and sealing operations are complete, a positioning device is selectively engagable with the slotted wheel for aligning the tape with the slots in the wheel in the running direction thereof, to thereby allow its insertion into the slots. The strapping apparatus is then ready for banding another package or group of packages.

In the apparatus of the present invention, the slotted wheel, without additional actuation, is moved into the position necessary for inserting the tape without a second ratchet wheel being necessary for this purpose. It is thereby possible to improve an already existing design, such as, for example, the one according to EP-A1-0 188 720. However, the invention is not restricted to an improvement of the known apparatus but can be used just as usefully and advantageously in other new designs.

Other objects and features of the present invention will become apparent from the following detailed description considered in connection with the accompanying drawings, which disclose an embodiment of the invention. It is to be understood that the drawings are to be used for the purposes of illustration only, and not as a definition of the limits of the invention.

BRIEF DESCRIPTION OF THE DRAWINGS

In the drawings, wherein similar reference characters denote similar elements throughout the several views:

FIG. 2 is an enlarged elevation view of the mechanism shown in FIG. 1, including the positioning device of the present invention in position for the welding operation;

FIG. 3 is a plan view of the embodiment shown in FIG. 2;

DESCRIPTION OF THE PREFERRED EMBODIMENT

Figure 1:
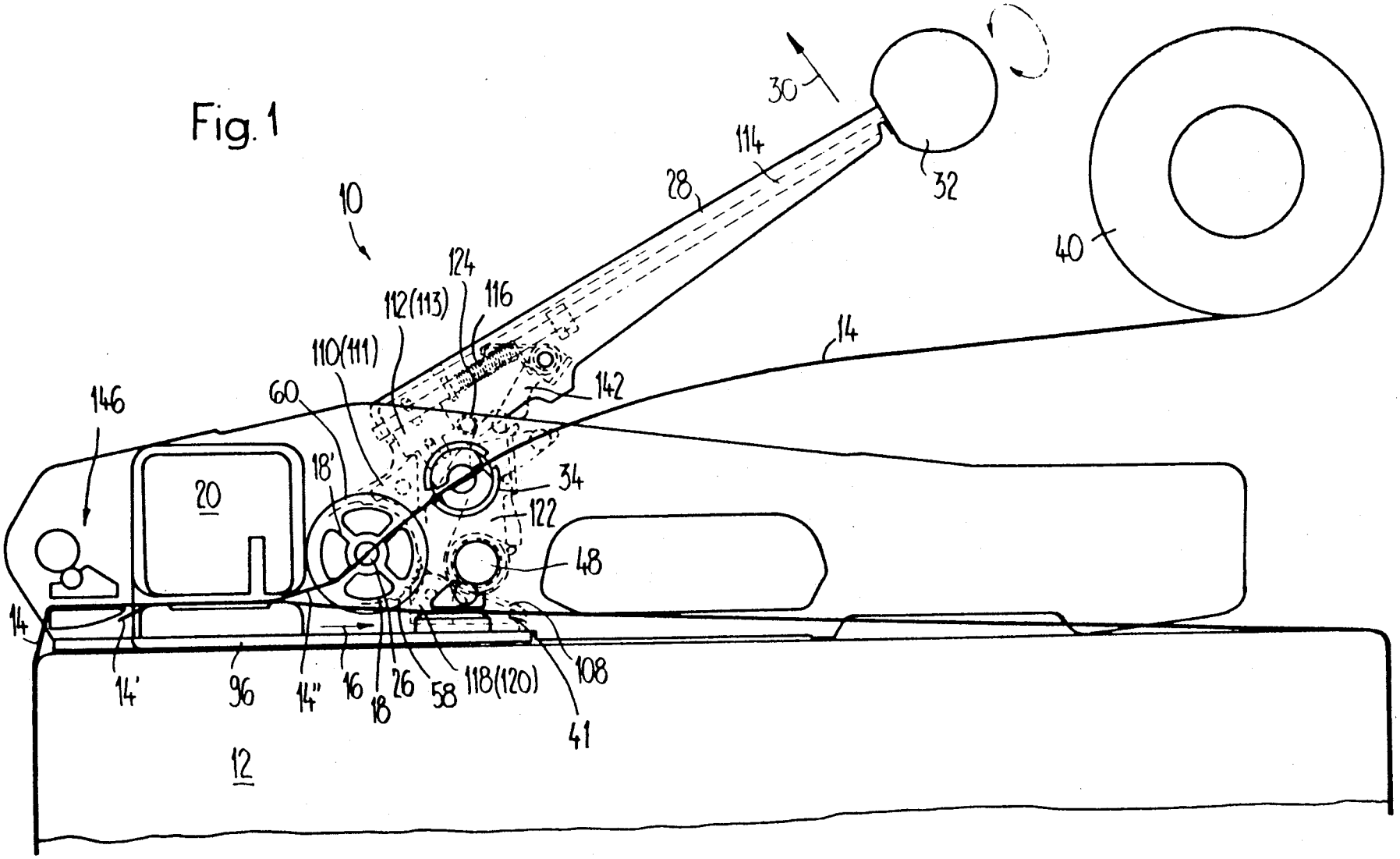
FIG. 1 is an elevation view of the strapping apparatus of the present invention.

Referring to FIG. 1, there is shown a strapping and sealing apparatus generally designated as 10. Strapping apparatus 10 is placed onto a package 12 in order to weld a thermoplastic tape 14 at its ends 14' and 14'' around the package. Strapping and sealing apparatus 10 has a welding device 20 which, viewed in the tape tightening direction of arrow 16, is arranged in front of a slotted wheel 18 intended to tighten tape 14.

To receive tape 14, slotted wheel 18 has at least one laterally open slot 18' extending radially across the wheel 18. If slotted wheel 18 is now turned counterclockwise, the inserted tape is pulled in direction 16 and tightened around the package. An actuating lever 28, pivotable about axis 26 of slotted wheel 18 in the direction of arrow 30, is used to turn slotted wheel 18. During such a pivoting movement, a driving pawl 110 mounted on actuating lever 28 engages the teeth of a ratchet wheel 58 which is non-rotationally connected to slotted wheel 18, causing wheel 18 to rotate and tighten the tape. A locking pawl 118 holds slotted wheel 18 in the tightened position.

Actuating lever 28 has a handle or knob 32 which can be held to actuate lever 28 and which can also be rotated about its axis. By turning knob 32 about its axis, actuation of changeover device 112, 113 occurs via changeover rod 114. By means of this changeover device, either driving pawl 110, which engages ratchet wheel 58, or a second driving pawl 111 which acts on cam plate 60 and which is arranged on the same axis but behind pawl 110, is released. A resetting spring 116 is used to reset the changeover device 112, 113, 114.

Located behind locking pawl 118 and engaging ratchet wheel 58 is a second locking pawl 120 which interacts with cam plate 60. A releasing lever 122, pivotable about a shaft 48, is used to unlock locking pawls 118 and 120. Releasing lever 122 is pivoted clockwise against the force of a torsion spring 108 by a roller 124 arranged on actuating lever 28.

The essential elements of strapping and sealing apparatus 10 are mounted on a base plate 96. In operation, base plate 96, with apparatus 10 thereon, is placed onto package 12. Plastic tape 14, which is to be wrapped around package 12, is pulled off of supply roller 40. After being looped around package 12, the tape is placed into welding device 20, and inserted into one of slots 18' of slotted wheel 18 and into a cutting device 34. Since the remaining functions are well known and not pertinent to the present invention, they will not be described in detail. Reference may be made to EP-A1-0 188 720 already mentioned, for such details.

Referring to FIG. 2, there is shown the essential features of the invention on a larger scale than in FIG. 1. To orient this figure with respect to FIG. 1, reference should be made to base plate 96 and the extension of actuating lever 28. The changeover device already described above with reference to FIG. 1 has two slides 112 and 113 which are displaceably mounted in actuating lever 28. Either slide 112 interacts with driving pawl 110 or slide 113 interacts with second driving pawl 111 as a function of the position of rotatable handle 32 according to FIG. 1.

The two driving pawls 110, 111 are mounted independently of one another on the same shaft 109 and are each pretensioned in a counterclockwise direction by tension springs 134 and 136, respectively. In the position shown in FIG. 2, driving pawl 110 has been lifted from ratchet wheel 58, while second driving pawl 111 interacts with cam plate 60. When the operation of tightening the plastic tape (not shown in FIG. 2) is complete, the tension of the tape is maintained by slotted wheel 18, since the latter is locked by locking pawl 118 acting on ratchet wheel 58. Locking pawl 118 is urged into contact with ratchet 58 by the force of a torsion spring 119.

Figure 4:
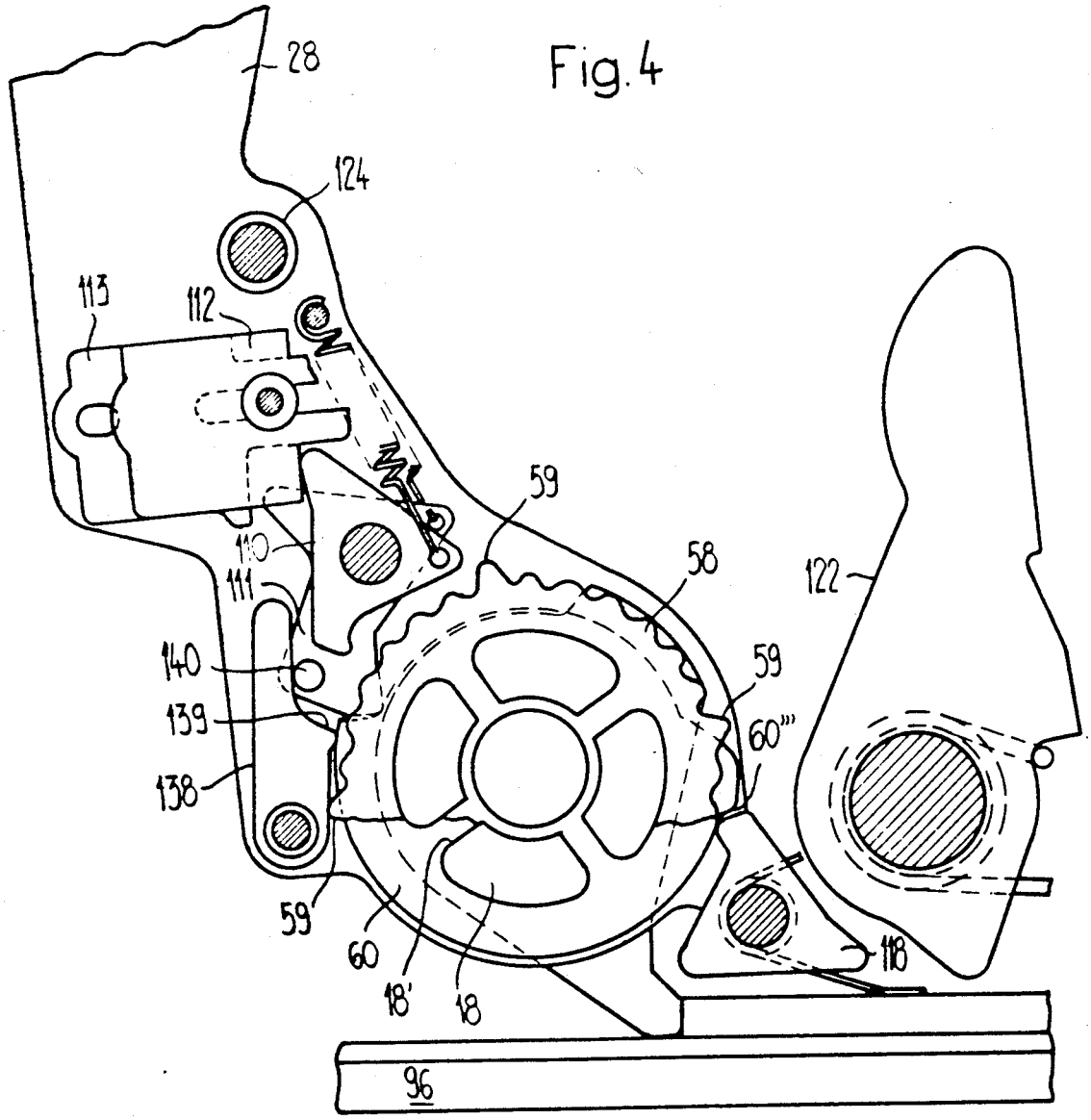
FIG. 4 is an elevation view of the mechanism shown in FIG. 2 with the positioning device set in the initial position.

If actuating lever 28 is now pivoted counterclockwise about axis 26, second driving pawl 111 mounted on actuating lever 28, with its nose 111', acts on the flank 60' of cam plate 60 in order to turn the cam plate counterclockwise. As a result, cam plate 60, with its cam surface 60'', lifts locking pawl 118 from ratchet wheel 58. Ratchet wheel 58 is now freely rotatable. Once a turning operation is complete, locking pawl 118 engages the offset section 60''' as shown in FIG. 4, and prevents the same from turning back since the engagement is maintained under spring pressure. The position thus reached serves to initiate the welding operation.

When actuating lever 28 is swung back clockwise, nose 139 of a resetting lever 138 acts on one of the resetting teeth 59 protruding radially beyond the other teeth of ratchet wheel 58 and in doing so drives the ratchet wheel 58 clockwise. The clockwise movement of ratchet 58 continues until the second driving pawl 111, via the changeover device 112, 113, disengages resetting lever 138 from ratchet wheel 58 by means of a driving pin 140. When actuating lever 28 is pressed in the downward direction, changeover device 112, 113 is reset by means of resetting spring 116 by a changeover pawl 142 shown in FIG. 1.

Figure 5:
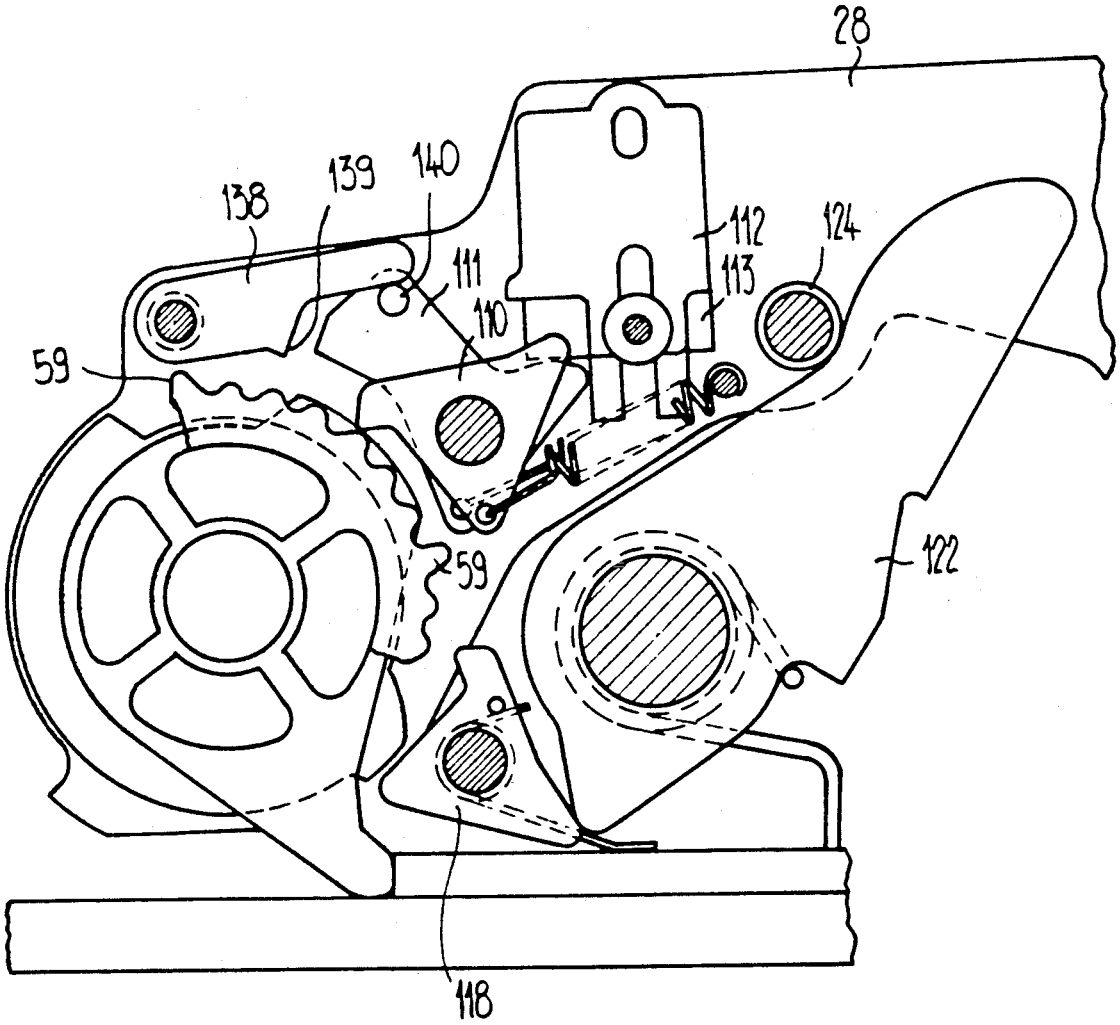
FIG. 5 is an elevation view of the mechanism shown in FIG. 2 with the positioning device set to its initial position and ready for the insertion of a new tape.

Raised resetting teeth 59 on ratchet wheel 58 are arranged in a fixed angular position relative to insertion slots 18' of slotted wheel 18. This ensures that slots 18', once the strapping operation is complete, are always located in such a position that slotted wheel 18, when plastic tape 14 is inserted according to FIG. 1, assumes an optimum position as shown in FIG. 5. It is also apparent from FIG. 2 that resetting lever 138 is tensioned in the clockwise direction by a torsion spring 144.

Releasing lever 122 is pivotable about shaft 48 which is fixed to the housing 2, and is swung clockwise by actuating lever 28 against the force of its restoring spring 108. This movement is caused by roller 124 mounted on actuating levers 28 rolling on a cam surface 123 of releasing lever 122. When swung clockwise, releasing lever 122, with its nose 122', acts on locking pawl 118 in order to lift the latter from ratchet wheel 58.

Referring to FIG. 3, there is shown a partial plan view of the elements arranged in actuating lever 28. In this view, slides 112 and 113 of the changeover device have been omitted.

Although the features essential to the invention have been explained with reference to a known strapping and sealing apparatus, it is likewise possible, as already mentioned, to use the novel features of the present invention in a strapping apparatus which is used in connection with a separate sealing apparatus.

The automatic or semi-automatic optimal positioning of slotted wheel 18 for inserting the tape is not restricted to the direction of rotation opposite the tightening direction. The desired positioning can also be effected by a forward rotation of the slotted wheel which corresponds to the direction of rotation during tightening. Nor is it necessary to lift driving pawl 110 and locking pawl 118 from the ratchet wheel. It is also conceivable to uncouple the slotted wheel from the ratchet wheel during positioning so that lifting the pawls mentioned are likewise unnecessary.

In a preferred embodiment of the invention, the positioning is effected by actuating the actuating lever used in particular for tightening the tape so that no additional actuating elements for the positioning operation are necessary.

If a cam plate 60 is provided to lift locking pawl 118 from the ratchet wheel 58, then already tightened tape end 14'' must continue to be held under tension at another location. For this purpose, in the exemplary embodiment shown in FIG. 1, there is a further clamping device 146 at the welding device 20. Clamping device 146 is activated by the movement of cam plate 60 before locking pawl 118 is lifted from ratchet wheel 58.

FIG. 1 also shows the feature of releasing the upper section 14' of the packaging strap 14 after termination of the tensioning operation. This releasing of section 14' facilitates the friction welding of the two strap sections 14', 14''. In order to hold the tension in the strap 14, both ends 14', 14'' of the strap 14 have to be clamped by clamping devices 41 and 146.

While only one example and embodiment of the present invention has been shown and described, it is obvious that many changes and modifications may be made thereunto, without departing from the spirit and the scope of the invention.

What is claimed is:

1. A strapping apparatus for a packaging strap applied around an item to be packed, said packaging strap having a lower section and an upper section, comprising:

a clamping device for retaining the lower section of the packaging strap;

a tensioning device intended to act upon the upper section of the packaging strap for tensioning the latter;

a releasing device intended to act upon the tensioning device after termination of the tensioning operation for releasing the upper section of the packaging strap; and a second clamping device arranged upstream of the tensioning device seen in the tensioning direction and acting upon the packaging strap prior to the release of the upper section of the packaging strap.

2. A strapping apparatus as claimed in claim 1, wherein the tensioning device comprises:

a tensioning wheel intended to act upon the packaging strap;

an actuating lever coupled to said tensioning wheel for rotation in a forward or tensioning direction; and a locking mechanism for preventing rotation of the tensioning wheel in a backward direction which is unlocked by the releasing device after termination of the tensioning operation.

3. A strapping apparatus as claimed in claim 2, wherein the tensioning wheel is non-rotatably coupled to a ratchet wheel; and a locking pawl of the locking mechanism acting upon said ratchet wheel.

4. A strapping apparatus as claimed in claim 3, wherein said releasing device comprises a cam plate for acting upon the locking pawl.

5. A strapping apparatus as claimed in claim 4, wherein said tensioning wheel has a shaft;

wherein said cam plate is rotatably mounted on the shaft of the tensioning wheel;

said cam plate being rotated into a release position by said actuating lever after termination of the tensioning operation; and said cam plate acting upon said locking pawl in said release position.

6. A strapping apparatus as claimed in claim 2, wherein said tensioning wheel is a slotted wheel which is provided with slots for inserting the packaging strap therein.

7. A strapping apparatus as claimed in claim 1, further comprising a welding device arranged between said second clamping device and said tensioning device for welding together the overlapping upper and lower sections of the packaging strap.

* * * * *